United States Patent [19]

Sheffield et al.

[11] 4,116,036

[45] Sep. 26, 1978

[54] HYDRAULICALLY OPERATED RIVETING APPARATUS

[75] Inventors: David John Sheffield, Hemel Hempstead; John William Charles Saxon, Sawtry, both of England

[73] Assignee: Aerpat A.G., Zug, Switzerland

[21] Appl. No.: 786,192

[22] Filed: Apr. 11, 1977

[30] Foreign Application Priority Data

Apr. 12, 1976 [GB] United Kingdom ..... 14767/76

[51] Int. Cl.[2] ..... B21J 15/22

[52] U.S. Cl. ..... 72/391; 60/585; 72/453.17

[58] Field of Search ..... 72/391, 453.17, 453.19, 72/453.02; 60/585, 592

[56] References Cited

U.S. PATENT DOCUMENTS 3,367,166 2/1968 Newton ..... 72/453.17

3,646,757 3/1972 Sanders ..... 60/592

FOREIGN PATENT DOCUMENTS 927,366 4/1947 France ..... 60/585

*Primary Examiner*—C.W. Lanham
*Assistant Examiner*—Gene P. Crosby
*Attorney, Agent, or Firm*—Oblon, Fisher, Spivak, McClelland & Maier

[57] ABSTRACT

Hydraulic operated blind riveting apparatus includes a pneumatic/hydraulic intensifier 23 and a reservoir 45 of hydraulic fluid for making up loss of hydraulic fluid. The reservoir is connected to the hydraulic system by a quick acting priming valve 47, actuated by the pneumatic feed to the intensifier. This priming valve is arranged to open and close before there is any effective change in pressure in the hydraulic system due to the action of the intensifier.

2 Claims, 2 Drawing Figures

HYDRAULICALLY OPERATED RIVETING APPARATUS

The invention relates to hydraulically operated riveting apparatus, that is, riveting apparatus in which operation of the riveting head is effected by the application of pressure to the riveting head. More particularly, the invention relates to such apparatus which includes a pneumatic/hydraulic intensifier for the application of hydraulic pressure. Such apparatus is described in British Pat. No. 578,105.

In such apparatus, problems can arise due to deficiency in volume of hydraulic fluid which may be caused by, for example, the riveting head piston returning more slowly than the intensifier hydraulic piston, or leakage end loss of hydraulic fluid. Any such deficiency must be made up before the start of the next working cycle of the apparatus. The present invention seeks to overcome such problems.

The invention provides, in or for hydraulically operated riveting apparatus in which operation of the riveting head is effected by the application of hydraulic pressure to the riveting head, hydraulic pressure generation apparatus which includes a hydraulic pressure generator for generating hydraulic pressure;

a hydraulic conduit connecting the generator and the riveting head and confining hydraulic working fluid to apply hydraulic pressure to the head from the generator;

a reservoir for hydraulic fluid;

valve means operable to connect the hydraulic working fluid between the pressure generator and riveting head to the reservoir;

and valve control means for causing the valve means to close at the start of each application of hydraulic pressure by the generator and to open at the cessation of each application of hydraulic pressure by the generator.

The invention includes both hydraulic pressure generation apparatus as aforesaid for use with a hydraulically operated riveting apparatus, and hydraulically operated riveting head and hydraulic pressure generation apparatus as aforesaid.

The valve means may connect to the hydraulic working fluid at any convenient point but in one preferred embodiment of the invention the valve means connects to the hydraulic working fluid at the generator itself.

In one form of apparatus embodying the invention, the hydraulic pressure generator is actuated pneumatically (i.e. it comprises a pneumatic/hydraulic intensifier), the valve means is pneumatically operated, and the valve control means comprises pneumatic means connecting the valve means and the pneumatic actuating means for the hydraulic pressure generator.

Figure 1:
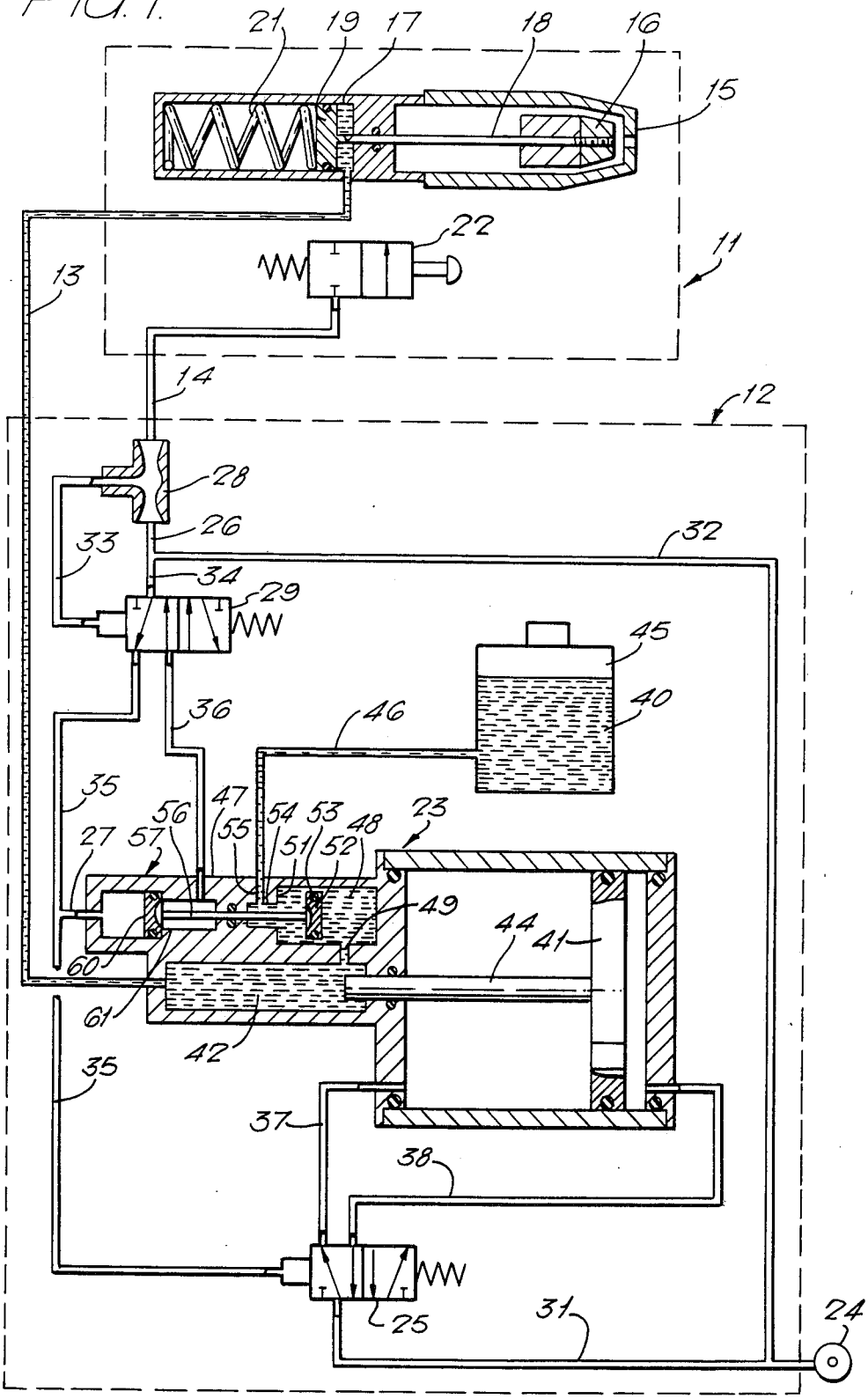
Figure 2:
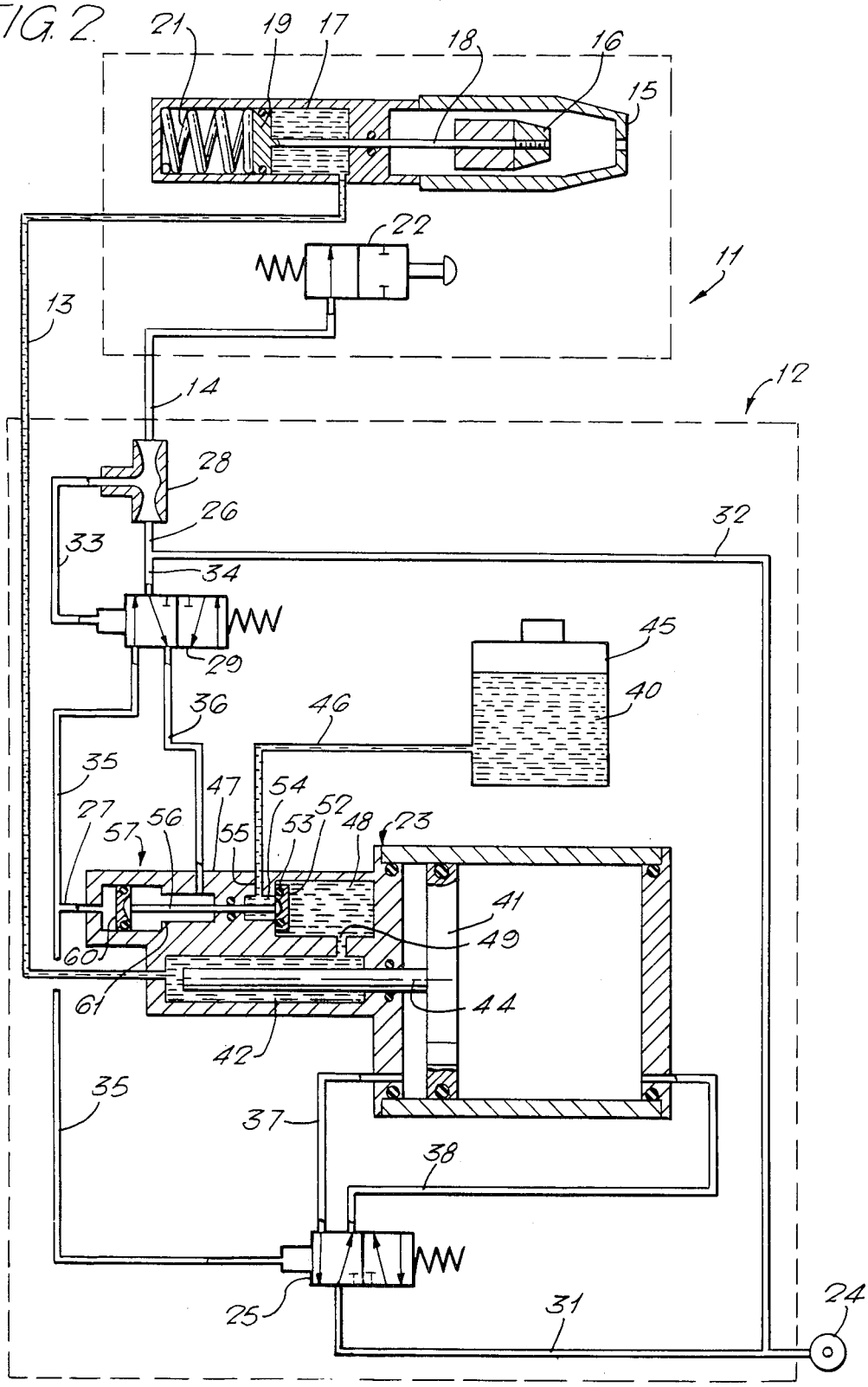

A specific embodiment of the invention will now be described by way of example and with reference to the accompanying drawings, in which:

FIG. 1 is a schematic hydraulic circuit diagram of a hydraulically operated riveting apparatus in the normal or rest position, and its associated pressure generator and control means, and FIG. 2 is a similar diagram showing the apparatus at the end of its working stroke.

In this example, the riveting apparatus comprises a riveting head 11, and a separate hydraulic pressure generator 12. These are interconnected by two flexible hoses, a hydraulic pressure hose 13, and an air hose 14.

The general design, construction and operation of such head and generator are well known and will be described here only briefly.

The riveting head 12 is designed to place blind rivets of the type in which an inner stem or mandrel has to be pulled through an outer body or shell to produce deformation of the latter. It may alternatively be designed to place the non-blind type of fastener known as a lockbolt, in which an outer sleeve or collor is swaged onto an inner stem or pin. In both cases the head is required to retract an inner member forcibly with respect to an outer member. To this end, the head includes an annular anvil 15 for abutting the outer member and a pair of jaws 16 for gripping the inner member. The anvil is connected to a head cylinder 17 and the jaws are connected via drawrod 18 to a single-acting head piston 19. The application of hydraulic pressure via hose 13 to cylinder 17 causes retraction of the drawrod and jaws against the urging of a return spring 21. The riveting head also contains a push-button valve 22 which is connected to hose 14. When the valve 22 is operated it opens against a return spring and vents hose 14 to atmosphere, as illustrated in FIG. 2, thus actuating the generator as will be described below.

The generator 12 comprises a pneumatic/hydraulic intensifier 23 and its associated pneumatic control gear. Compressed air from an air line is connected via input coupling 24 to a number of branches; firstly via conduit 31 to the input of a 5-port single pilot spring return valve 25; secondly via conduit 32 and conduit 26 to the input of a venturi T-piece 28 and thus via the output of the venturi to hose 14 and valve 22; and thirdly via conduit 32 and conduit 34 to the input of a 5-port single pilot spring return valve 29. The negative pressure branch of venturi 28 is connected via conduit 33 to the control input of valve 29. One output of valve 29 is connected via conduit 35 to the pilot input of valve 25 and also via branch conduit 27 to one side of the pneumatic section 57 of priming valve 47. The other output of valve 29 is connected via conduit 36 to the other side of the pneumatic section 57 of valve 47. The two outputs of valve 25 are connected via conduits 37 and 38 to the two sides of the doubleacting pneumatic piston 41 of the intensifier 23. The single output of the hydraulic cylinder 42 of the intensifier is connected to hose 13 and thus to riveting head cylinder 17.

When compressed air is supplied through the coupling 24 and spring biassed push button valve 22 is in the normally closed position, the condition of the apparatus is as shown in FIG. 1. Conduit 32 is pressurised but since valve 22 is closed air cannot flow along pipe 14. Instead of a negative pressure in conduit 33, this conduit is pressurized with air and therefore valve 29 is held open against the urging of its spring. Conduit 35 is thus connected via conduit 36 and valve 29 to conduit 34 and is pressurised. Conduit 36 is vented so that, as viewed in FIG. 1, valve 25 is held to the right and compressed air is fed to the left of the intensifier piston whilst the rear is vented, thus holding the intensifier piston 41 to the right and the piston rod 44 retracted.

When the push button valve 22 is opened, hose 14 and conduit 32 are vented. There is thus produced a relatively high velocity flow of air, from the input 24, through conduits 32 and 26, through the venturi 28, and then through hose 14 and valve 22, to atmosphere. The high velocity air flow through the venturi 28 produces a negative air pressure in the branch 33, which co-operates with the urging of the spring of valve 29 to cause valve 29 to change over very rapidly. This connects conduit 35 to pressure air, so that valve 25 also changes over against its spring, as shown in FIG. 2. Thus valves 29 and 25 change over, and the air connections to the intensifier are reversed thus forcing the piston and its piston rod 44 forwards (i.e. to the left of FIG. 1) and applying hydraulic pressure to actuate the riveting head piston, towards and into the position shown in FIG. 2. On release and closing of push button valve 22, the intensifier reverses to its original position and the spring 21 returns the head piston to its original position shown in FIG. 1.

The whole space within the hose 13, intensifier hydraulic cylinder 42 and the working side of head cylinder 17 is of course filled with hydraulic working fluid 40.

In order to provide make-up of hydraulic fluid to compensate for losses due to leakage or cavitation, there is provided a hydraulic fluid reservoir 45 which is mounted above the intensifier hydraulic cylinder 42 and connected to it by a conduit 46 and a pneumatically actuated priming valve 47.

The valve 47 comprises a valve chamber 48 communicating with the intensifier hydraulic cylinder 42 by means of a bore 49. The chamber contains an annular valve seat 51 which is closed by a valve member 52 fitted with a face seal ring 53. On the other side of the seat 51, a passage 54 communicates via bore 55 with conduit 46 from the reservoir. The valve member 52 is mounted on a rod 56 which is reciprocated by a double-acting pneumatic piston and cylinder device 57, including a piston 60 secured to rod 56. The stroke of the rod 56 is limited by a stop 61 within the pneumatic cylinder. One side of this device is connected to pneumatic conduit 35, and the other side to pneumatic conduit 36, such that when conduit 35 is pressurised and conduit 36 vented, the valve 47 is opened, and when conduit 35 is vented and conduit 36 is pressurised and valve 47 is closed. Thus the pilot valve 29 controls both the intensifier pneumatic piston 41 and the priming valve 47. However, the valve 47 has low inertia, whereas the intensifier piston 41 and 44 has higher inertia, coupled to the frictional resistance to flow of the hydraulic fluid, and a slight delay in actuation due to the interposition of valve 25 between it and valve 29. Consequently, whenever valve 29 changes position, priming valve 47 also changes position before there is any effective movement of intensifier piston 44 and corresponding change in hydraulic fluid pressure. Thus the priming valve 47 shuts as soon as the intensifier starts to pressurise the hydraulic fluid, and thereby closes the connection between the pressurised working hydraulic fluid and the reservoir. As soon as the intensifier piston starts its return stroke the valve 47 opens, thereby reconnecting the working fluid to the reservoir until the start of the next pressure stroke of the intensifier. In this way, if the intensifier piston returns faster (as far as volume displacement is concerned) than the head piston, the negative pressure created will draw such fluid from the reservoir instead of causing cavitation. When the intensifier has completed its return stroke, the head piston will still be returning under the urging of the head spring 21 and will thus return the excess fluid to the reservoir, leaving sufficient fluid from the reservoir in the working fluid space to make up for any deficiency caused by leakage, thereby ensuring that the working fluid space is completely filled with hydraulic fluid. As soon as the intensifier piston starts its next pressure stroke, the priming valve 47 closes, sealing off the reservoir from the rest of the hydraulic circuit. Moreover, as soon as the pressure of the working hydraulic fluid rises, it forces the valve member 52 firmly into sealing relationship with its seat 51, thereby reducing the possibility of any leakage of pressurised fluid through the valve 47.

The invention is not restricted to the details of the foregoing example.

We claim:

1. In or for hydraulically operated riveting apparatus in which operation of the riveting head is effected by the application of hydraulic pressure to the riveting head, hydraulic pressure generation apparatus which includes a hydraulic pressure generator for generating hydraulic pressure;

a hydraulic conduit connecting the generator to the riveting head for feeding hydraulic pressure from the generator to the head;

a reservoir for hydraulic fluid;

valve means operable to open and thereby connect the hydraulic conduit and the pressure generator to the reservoir and to close and thereby to disconnect the hydraulic conduit and the pressure generator from the reservoir;

and valve control means for causing the valve means to close at the start of each application of hydraulic pressure by the generator and to open at the cessation of each application of hydraulic pressure by the generator.

2. In or for hydraulically operated riveting apparatus in which operation of the riveting head is effected by the application of hydraulic pressure to the riveting head, hydraulic pressure generation apparatus which includes a hydraulic pressure generator for generating hydraulic pressure;

a hydraulic conduit connecting the generator to the riveting head for feeding hydraulic pressure from the generator to the head;

a reservoir for hydraulic fluid;

pneumatic actuating means for pneumatically actuating the hydraulic pressure generator;

valve means operable to open and thereby connect the hydraulic conduit and the pressure generator to the reservoir and to close and thereby to disconnect the hydraulic conduit and the pressure generator from the reservoir;

and valve control means for causing the valve means to close at the start of each application of hydraulic pressure by the generator and to open at the cessation of each application of hydraulic pressure by the generator; the said valve control means comprising a pneumatic connection operatively connected to the said pneumatic actuating means.

* * * * *